US006562552B2

(12) United States Patent
Toyoda et al.

(10) Patent No.: US 6,562,552 B2
(45) Date of Patent: May 13, 2003

(54) METHOD OF MANUFACTURING PANEL ASSEMBLY USED TO ASSEMBLE DISPLAY PANEL AND TRANSFER MATERIAL SHEET

(75) Inventors: Osamu Toyoda, Kawasaki (JP); Shinji Tadaki, Kawasaki (JP); Akira Tokai, Kawasaki (JP); Keiichi Betsui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/770,294

(22) Filed: Jan. 29, 2001

(65) Prior Publication Data

US 2001/0008825 A1 Jul. 19, 2001

Related U.S. Application Data

(63) Continuation of application No. PCT/JP99/02359, filed on Apr. 30, 1999.

(30) Foreign Application Priority Data

Aug. 11, 1998 (JP) ..... 10-226662

(51) Int. Cl.[7] ..... H01J 11/00

(52) U.S. Cl. ..... 430/321; 430/319; 430/258; 430/259; 430/260

(58) Field of Search ..... 430/26, 319, 321, 430/259, 260, 258; 445/24, 35, 52; 428/202, 690; 156/67, 89.11, 89.12, 247, 230, 232; 313/582, 584

(56) References Cited

U.S. PATENT DOCUMENTS 5,141,461 A * 8/1992 Nishimura et al. ..... 445/52
5,426,342 A * 6/1995 Nakamura et al. ..... 313/496
5,992,320 A * 11/1999 Kosaka et al. ..... 101/401.1

FOREIGN PATENT DOCUMENTS

| | | | |
|---|---|---|---|
| JP | Hei. 2-209487 | | 8/1990 |
| JP | Hei. 3-222236 | | 10/1991 |
| JP | Hei. 7-29497 | | 1/1995 |
| JP | Hei. 9-245630 | | 9/1997 |
| JP | Hei. 10-149763 | | 6/1998 |
| JP | Hei. 10-149765 | | 6/1998 |
| JP | Hei. 10-289656 | | 10/1998 |
| JP | Hei. 10-294061 | | 11/1998 |
| JP | 11-016503 A | * | 1/1999 |
| JP | 11-114481 A | * | 4/1999 |
| JP | Hei. 11-162339 | | 6/1999 |

* cited by examiner

*Primary Examiner*—John A. McPherson
(74) *Attorney, Agent, or Firm*—Staas & Halsey LLP

(57) ABSTRACT

A method of manufacturing a panel assembly used to assemble a display panel intends to achieve an alignment-free between barrier ribs and a fluorescent layer and minimize the waste of a barrier rib material for cost reduction. On a support body 51 which is not a substrate, formed are a plurality of walls 281 through 283 made of a fluorescent material that are belt-shaped in plan view arranged in stripes, an electrode material layer a1, and a barrier rib material filling spaces between the walls. The support body 51 and a substrate 21 are coupled so that the barrier rib material faces the substrate. The walls 281 through 283, the electrode material layer a1 and the barrier rib material 291 are transferred in one step to the substrate 21, and thus a panel assembly 20 having barrier ribs 29, electrodes A and fluorescent layers 28R, 28G and 28B is obtained.

29 Claims, 15 Drawing Sheets

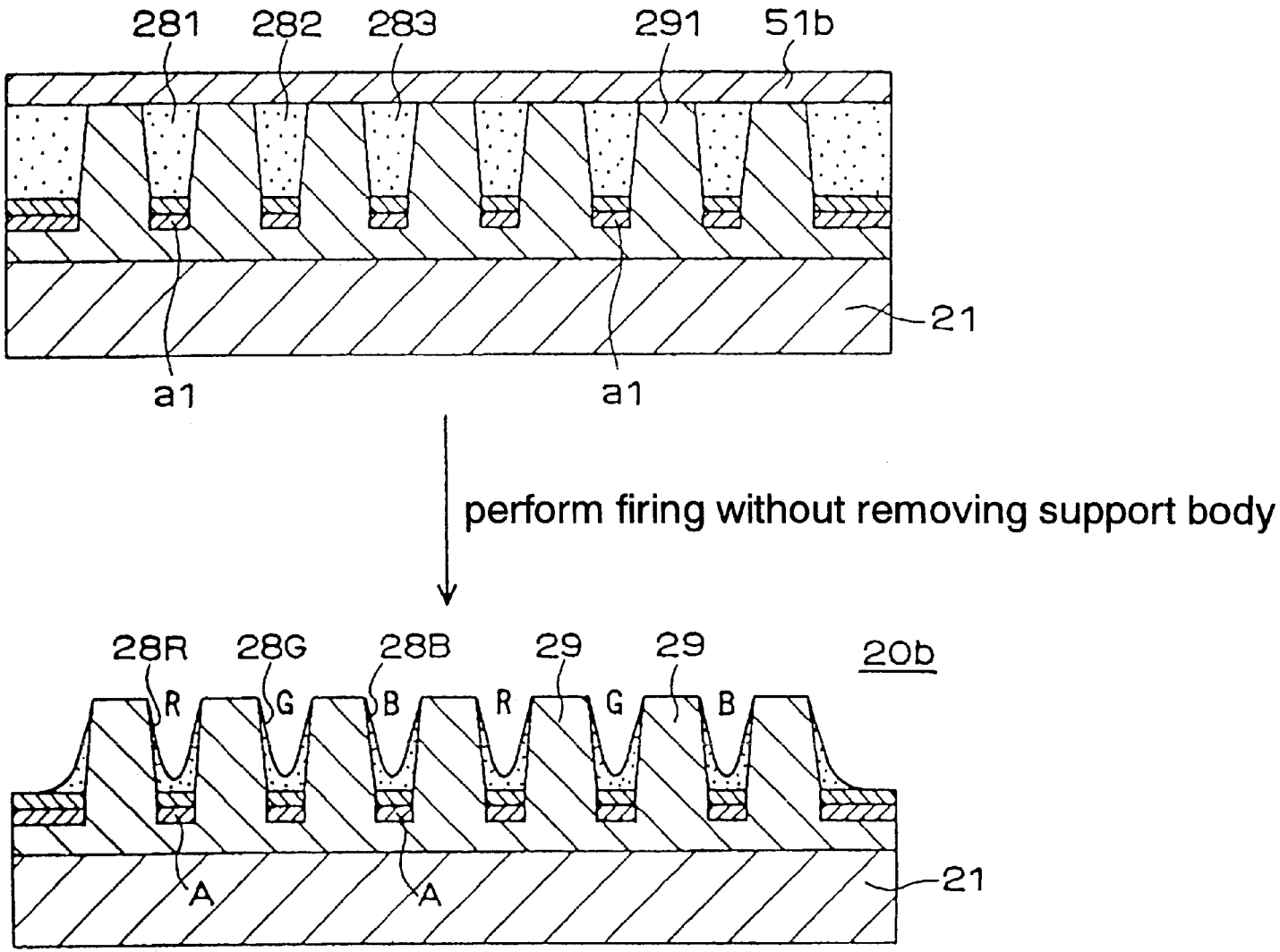
FIG.7(F')
FIG.7(G')

292
52
21

62
52
292
21

20C
28R
28G
28B
R
G
B
A
21

52
62
62
62

284
285
286
R
G
B
62

272
272

52
62
a2
a2
a2

292

63
63
63
53

287
288
289
R
G
B
R
G
B 293
53

53
293
A
A
21

53
63

20d
28R
28G
28B
R
G
B
R
G
B
A
A
21

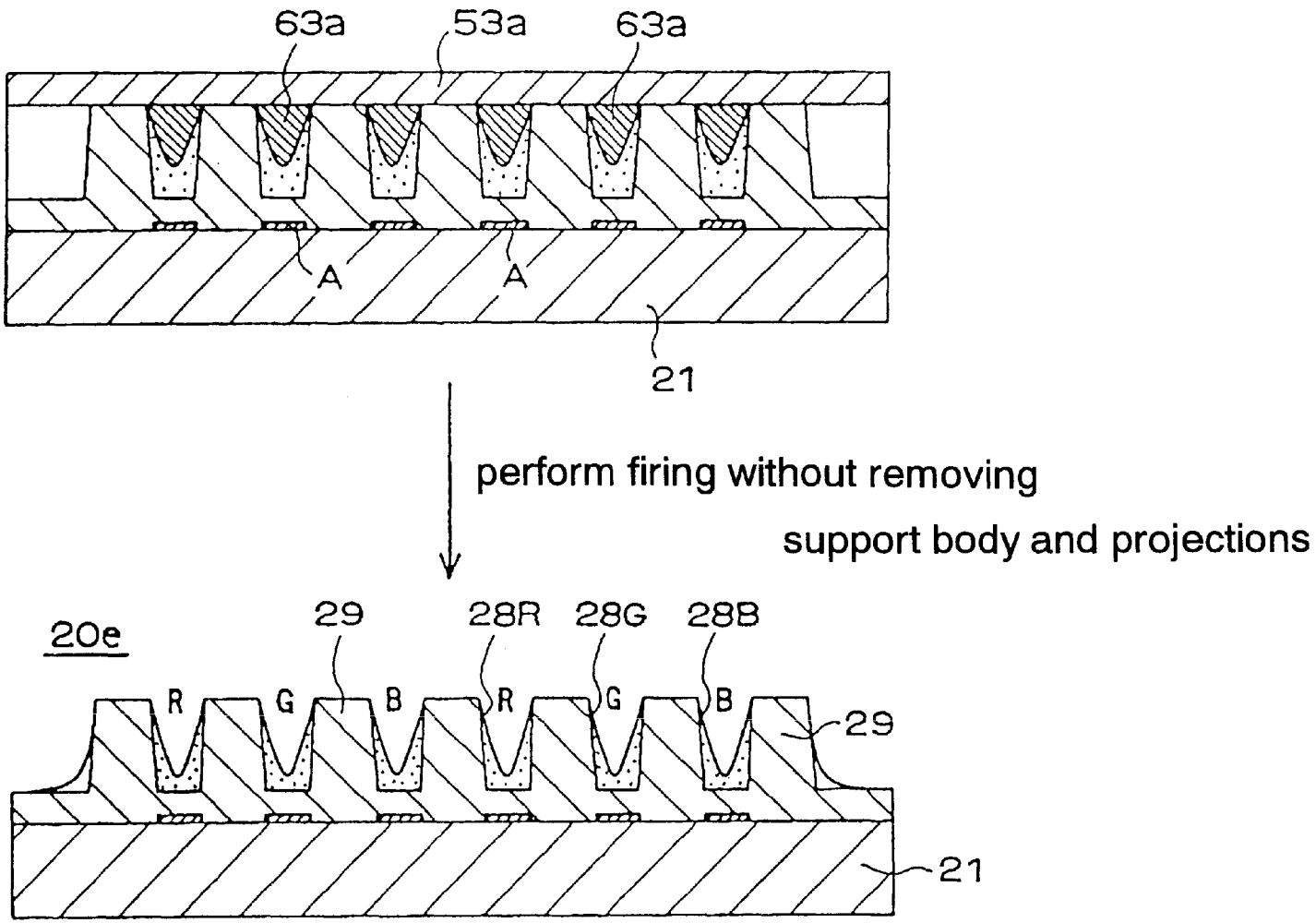
FIG.11(E')
FIG.11(F')

METHOD OF MANUFACTURING PANEL ASSEMBLY USED TO ASSEMBLE DISPLAY PANEL AND TRANSFER MATERIAL SHEET

This application is a continuing application, filed under 35 U.S.C. §111(a), of International Application PCT/JP99/02359, filed Apr. 30, 1999, it being further noted that priority is based upon Japanese Patent Application 10-226662, filed Aug. 11, 1998.

TECHNICAL FIELD

The present invention relates to a method of manufacturing a panel assembly used to assemble a display panel and a transfer material sheet used to manufacture the panel assembly.

BACKGROUND ART

PDP (plasma display panel), a kind of display panel, has been getting widely used as display screens for television sets and monitors for computers since full color display was put into practical use. For further penetration, it is essential to develop a less expensive technique for manufacturing it.

An AC-type surface discharging PDP has been commercialized as a color display device. In the surface discharging system mentioned herein, light is maintained by making use of wall charge under AC drive and first main electrodes and second main electrodes which alternatively serve as positive electrodes or negative electrodes are arranged in parallel on an inner surface of one substrate of a pair of substrates. According to this system, a fluorescent layer for color display is provided on a second substrate facing a first substrate on which pairs of main electrodes are arranged. Accordingly, deterioration of the fluorescent layer caused by ion impact during discharge can be alleviated and the PDP can be long lived.

In the surface discharging PDP, the first and the second main electrodes extend along the line direction so that third electrodes for selecting columns and barrier ribs of about 100 to 200 $\mu$m height for dividing discharge spaces by columns are required. The third electrodes are called as address electrodes and provided on the second substrate to reduce static capacity of cells. The barrier ribs prevent discharge coupling and color cross-talk between adjacent columns and define the size of the discharge space. Further, the fluorescent layer is preferably formed to cover not only surfaces parallel to a display screen but also sidewalls of the barrier ribs so that light emission area can be enlarged.

The PDP is completed through the steps of forming desired constituents such as electrodes on the first and the second substrates, coupling the substrates face to face to seal the circumference thereof (assembly step), cleaning the inside and sealing therein a discharge gas. In the manufacture of the display panel, a structure obtained by forming a layer of a predetermined pattern on a base substrate or processing the substrate itself to provide one or more constituent thereon is referred to as a "panel assembly".

In a method of manufacturing the panel assembly according to the prior art, constituents are sequentially formed on the substrate. That is, one panel assembly is produced by forming the main electrodes, a dielectric layer and a protective layer in this order on the first electrode. Another panel assembly is produced by forming the address electrodes, the barrier ribs and the fluorescent layer in this order on the second substrate.

As methods of forming the barrier ribs, known are screen printing, sand blast technique, photolithography and additive method (also referred to as a lift-off technique or a burying technique). The screen printing is a method of performing repetitive printing of glass paste. The sand blast technique partially removes a uniformly applied paste by spraying a polishing material. The photolithography is to photolithographically pattern a photosensitive paste which has been uniformly applied. The additive technique is to provide a mask having a negative pattern of the barrier ribs, fill the glass paste in the openings of the mask and then remove the mask.

For the formation of the fluorescent layer, the screen printing has often been utilized since fluorescent substances of three colors, R, G and B, need to be arranged regularly. In short, three screens each having an opening pattern corresponding to the arrangement of the fluorescent substances of three colors are used to sequentially apply the fluorescent pastes one after another to spaces between the barrier ribs. Other techniques for patterning the layer include dispenser technique, as well as photolithography utilizing a photosensitive fluorescent paste. In either technique, three florescent pastes are individually applied, dried and then fired in one step.

The method according to the prior art requires an advanced alignment technique for ensuring precision in positional relationship among the address electrodes, the barrier ribs and the fluorescent layer. If their relative positions are mal-aligned, moiré and color displacement are resulted.

Further, costs of a material for forming the barrier ribs are expensive, which has been an obstacle to price reduction. In the screen printing, the screen is extremely exhausted because the printing is repeatedly performed in multiple times. In the sand blast technique, the greater part of a barrier rib material turns to be scraps. In the photolithography, about two third of the photosensitive paste layer will be etched away. Further, in the additive method, all the mask material for burying the paste will finally be removed. Moreover, for the formation of the fluorescent layer, serious problem remains in accuracy in screen printing (accuracy in plate) and plate life. Also in the photolithography, a method of collecting the photosensitive material is still problematic. Even if the problem concerning the precision is solved, it is extremely difficult to fill the layer material into a space in the shape of groove surrounded by the barrier ribs without including any air bubbles, so that a problem of low yields still remains.

Further, it requires a lot of formation steps and time, and is troublesome to frequently move the assembly during the formation steps.

The object of the present invention is to realize an alignment-free between the barrier ribs and the fluorescent layer and to minimize a waste of the barrier rib material for cost reduction. Another object is to realize an alignment-free among the electrodes, the barrier ribs and the fluorescent layer. Still another object is to sequentially manufacture a plurality of panel assemblies to reduce manufacturing time and steps per one panel assembly.

DISCLOSURE OF INVENTION

The manufacturing method according to the present invention is a method of manufacturing a panel assembly used to assemble a display panel having at least a plurality of barrier ribs that are belt-shaped in plan view for dividing the screen by columns, a plurality of electrodes for selecting the column, and a fluorescent layer that is belt-shaped in plan view extending along sidewalls of the barrier ribs and above the electrodes in each column provided on a substrate greater than a desired screen, the method comprising: forming a plurality of walls made of a fluorescent material that are belt-shaped in plan view so that the walls are arranged in stripes on a support body which is not the substrate; forming an electrode material layer on the walls; filling a barrier rib material in a space between the walls; coupling the substrate and the support body so that the barrier rib material faces the substrate; and transferring the walls, the electrode material layer and the barrier rib material to the substrate in one step, thereby to form the barrier ribs, the electrodes and the fluorescent layer.

According to the manufacturing method of the present invention, a layered body including the fluorescent material and the barrier rib material is formed into a pattern on the support body which is not the substrate, and then the layered body is transferred from the support body to the substrate in one step. In the layered body, the fluorescent material is formed into walls of a sufficient height and arranged in stripes, and the barrier rib material is arranged to fill the walls. Thus, the positional relationship between the fluorescent layer and the barrier ribs can be self-aligned. If the electrode material layer is provided on the walls of the fluorescent material before the barrier rib material is filled, the positional relationship among the electrodes, the fluorescent layer and the barrier ribs can be self-aligned.

BRIEF DESCRIPTION OF DRAWINGS

FIGS. 1 to 15 are views relating to the present invention, wherein:

FIG. 1 is a plan view schematically illustrating an electrode arrangement in a PDP according to the present invention;

FIG. 2 is an exploded perspective view illustrating inner structure of the PDP according to the present invention;

FIG. 3 is a view for explaining manufacturing steps according to First Embodiment;

FIG. 4 is a view illustrating another embodiment of how to fill a barrier rib material;

FIG. 5 is a view for illustrating how to transfer when the electrodes are separately formed;

FIG. 6 is a schematic view illustrating how to transfer using a transfer material sheet;

FIG. 7 is a view for illustrating a varied embodiment of a firing step;

FIG. 8 is a view for explaining manufacturing steps according to Second Embodiment;

FIG. 9 is a view for explaining manufacturing steps according to Third Embodiment;

FIG. 10 is a schematic view illustrating how to transfer using the transfer material sheet;

FIG. 11 is a view for illustrating a varied embodiment of a firing step;

FIG. 12 is a view for illustrating a first example of a method of forming walls of a fluorescent material;

FIG. 13 is a view for illustrating a second example of the method of forming the walls of the fluorescent material;

FIG. 14 is a view for illustrating a first example of a method of forming dummy walls; and FIG. 15 is a view for illustrating a second example of the method of forming the dummy walls.

BEST MODE FOR CARRYING OUT THE INVENTION

Figure 1:
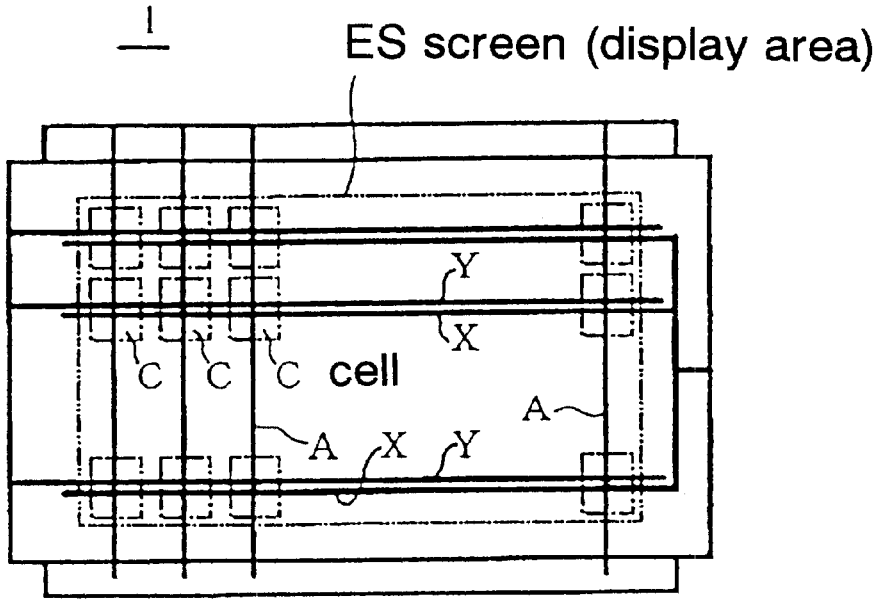

As described above, the manufacturing method according to the present invention is a method of manufacturing a panel assembly by forming a layered body including a fluorescent material and a barrier rib material arranged in pattern on a support body which is not a substrate and transferring the layered body from the support body to the substrate in one step.

In the manufacturing method according to the present invention, examples of the substrate include a substrate of glass, quartz, silicon and the like and a substrate of these materials on which constituents such as an electrode, an insulating film, a dielectric layer and a protective layer are formed.

The support body may preferably be of a flexible material such as a polyester film (PET). With such a flexible material, the manufacturing steps and the manufacturing time can be reduced. That is, for example, transfer layers corresponding to a plurality of panel assemblies are preliminarily formed in sequence on a belt-shaped film of a sufficient length, a cover film is attached thereon if necessary and then the film is rolled to prepare a transfer material sheet. Then the transfer is performed by a lamination technique in which a predetermined length of the film is pulled out and adhered on the substrate. The cover film which is no longer required is exfoliated immediately before the film is adhered. Thus, a line for preparing materials and a line for manufacturing the panel assembly can be separated. Accordingly, tact control can be achieved in factory designing and quality control can be facilitated.

A rigid material having a specific mechanical strength, e.g., glass, metal, ceramics and the like may be used as the support body. If such a rigid material is used, the sequential formation of the transfer layer may be difficult, but dimensional precision and positional precision in repetitive pattern formation will increase. Alternatively, an elastic material as represented by silicon rubber used in lithographic offset printing may be used as the support body. If such an elastic material is used, the transfer can stably be performed though the positional precision decreases to some extent.

As the fluorescent material, known materials that are ordinarily used in the art can be used. For example, a mixture of fluorescent particles and an organic binder can be used. Depending on the manufacturing method, the fluorescent material may be added with a photosensitive agent, a plasticizer for giving plasticity, or a substance for adjusting the shape after firing (dispersing agent or binder).

Also for the barrier rib material, known materials ordinarily used in the art can be used. The barrier rib material may be low melting glass, ceramics, or a mixture of a solid powder including these materials and an organic binder. The barrier rib material may be added with a plasticizer for giving plasticity or a substance for adjusting the shape after firing (dispersing agent or binder).

In the present invention, the transfer is performed from the support body to the substrate in one step. The transfer can be performed by ordinary press bonding. If adhesive power between the substrate and the layered body is greater than that between the support body and the layered body, the transfer can be easily carried out by the press bonding. However, in the opposite case, the transfer will be difficult.

In this case, a surface treatment may be given to the support body for exfoliation (release). The support body is required to have favorable releasability. However, adhesion between the layered body and the substrate is also required. Therefore, it is necessary to keep balance between the releasability and the adhesion taking yields of the entire steps into consideration. As the treatment for giving the releasability, may be employed silica coating, silicon coating or fluorine coating. It is effective to add a coupling agent (silane coupling agent or the like) to a material of the layered body in view of keeping balance with the adhesion. Application of a resin having a glass point at 50° C. or less is also an example of the treatment for giving the releasability. The release can easily be performed by heating the support body to soften the applied resin after the transfer. In general, resins turn to be fluidic at a temperature near the glass point and exhibit the adhesion. As the temperature increases, the viscosity of the resin itself decreases and the mechanical strength is reduced. Accordingly, with a suitable resin material, the adhesion is ensured by appropriately adjusting the adhesive power of the resin for patterning a layer on the support body, and then the support body can easily be removed by heating (warming in ideal sense) the entire substrate after the transfer. As the coating agent, may be added is a refractory oxide or plural resins each having different glass point to control various properties such as the adhesive power and the viscosity which varies according to the temperature.

In the manufacturing method according to the present invention, it is preferred to fire the walls, the electrode material layer and the barrier rib material in one step after they are transferred to the substrate and the support body is removed.

Where a flammable substance such as the polyester film as described above is used as the support body, it can be burned out when the walls, the electrode material layer and the barrier rib material are fired in one step after the transfer to the substrate. Accordingly, a step of removing the support body can be omitted.

The electrode material layer may be formed after an insulating layer is formed on the walls.

It may be possible to form outgoing wirings at an edge portion of the substrate for connecting the electrodes and external circuits prior to the coupling with the support body. Thus, the electrode material layer and the outgoing wirings are aligned when the substrate and the support body are coupled.

In this case, at least a part of the outgoing wirings is covered with an auxiliary sheet. By removing the auxiliary sheet after the walls, the electrode material layer and the barrier rib material are transferred to the substrate, the transfer can be performed only to a necessary region, which improves productivity.

In the manufacturing method according to the present invention, it may be possible to form the walls on the support body and bury spaces between the walls with the barrier rib material without forming the electrode material layer. Then the support body may be coupled with the substrate on which the electrodes have been arranged. That is, on the support body which is not the substrate, a plurality of walls made of the fluorescent material that are belt-shaped in plan view are arranged in stripes, spaces between the walls are buried with the barrier rib material. Then the support body may be coupled with the substrate on which the electrodes have been arranged so that the barrier rib material faces the substrate, thereby transferring the walls and the barrier rib material on the substrate in one step to form the barrier ribs and the fluorescent layer on the substrate.

Also in this method, it is preferred to fire the walls and the barrier rib material in one step after they are transferred to the substrate and the support body is removed. Further, a flammable substance such as a polyester film may be used as the support body.

In the manufacturing method according to the present invention, it may be possible to use, as the support body, a body on which projections that are belt-shaped in plan view are formed on regions for forming the walls, and then the walls may be formed on the projections.

In this case, the projections can be produced by applying a photosensitive material on the support body using a device provided with grooves configured to correspond to the shape of the projections and performing light exposure.

The walls may be formed by photolithography using a fluorescent material having photosensitivity.

In this case, the walls can be formed by providing a lightproof layer having openings in the regions for forming the walls on the support body made of a transparent material, providing a mask having openings arranged in different pitch from those of the lightproof layer on a rear surface of the support body, and then partially performing one or more light exposure step from the rear surface to the fluorescent material which has been uniformly applied onto a front surface of the support body for development.

The walls may be formed by applying the fluorescent material using a device having discharge outlets configured to correspond to the cross section of the walls.

In this case, the walls can be formed by simultaneously applying plural fluorescent materials each emitting light of different color and removing a portion around a boundary between the applied fluorescent layers of different kinds.

The walls may be subjected to a processing treatment for adjusting the shape thereof.

The walls may be formed by providing dummy walls configured to correspond to the shape of the walls on the support body, burying spaces between the dummy walls with the fluorescent material and then removing the dummy walls.

The dummy walls may be formed of a water-soluble material so that they can be removed by dissolving into water.

The dummy walls can be provided by forming a photosensitive material on the support body using a device having grooves configured to correspond to the shape of the dummy walls and then performing light exposure.

The dummy walls may be subjected to a processing treatment for adjusting the shape thereof.

In the manufacturing method described above, it is preferred to use a transfer material sheet as mentioned below. That is, it is desirable to use a transfer material sheet for forming a panel assembly used to assemble a display panel comprising, on a substrate greater than the size of a screen, at least a plurality of barrier ribs that are belt-shaped in plan view for dividing the screen by columns, a plurality of electrodes for selecting the column, and a fluorescent layer that is belt-shaped in plan view extending along the sides of the barrier ribs and above the electrodes in each column. The transfer material sheet is a rolled flexible body formed by coupling a plurality of support bodies on which provided are a plurality of walls made of a fluorescent material which are belt-shaped in plan view arranged in stripes, an electrode material layer covering an upper surface of the walls and a barrier rib material filled into spaces between the walls.

The transfer material sheet may be rolled with an auxiliary sheet which covers a part of the support bodies for preventing transfer.

The transfer material sheet without the electrode material layer is also possible. That is, it may be a rolled flexible body formed by coupling the plurality of support bodies on which provided are the plurality of walls made of the fluorescent material that are belt-shaped in plan view arranged in stripes and the barrier rib material filled in the spaces between the walls.

Further, the present invention is directed to a panel assembly formed in accordance with the method of manufacturing the panel assembly used to assemble the display panel as described above.

In the present specification, the panel assembly signifies almost the same as the so-called "panel assembly" as mentioned above. In a strict sense, however, it signifies an assembly comprising a support body in the shape of a plate greater than the screen and at least one panel constituent. Through the manufacturing steps for providing panel constituents of plural kinds on the substrate, an in-process item with a base substrate on which one or more panel constituent has been formed in each step is the panel assembly.

FIG. 1 is a plan view illustrating an example of an electrode arrangement in a PDP 1 according to the present invention.

The illustrated PDP 1 is a three-electrode surface discharging PDP of AC-type in which a first main electrode X and a second main electrode Y constituting a pair are arranged in parallel, and in a cell C the main electrodes X and Y cross an address electrode A which serves as a third electrode. The main electrodes X and Y extend along the line direction (horizontal direction) of a screen ES. The main electrode Y is used as a scanning electrode for selecting the cell C (display element) by lines at the addressing. The address electrode A extends in the column direction (vertical direction) and used as a data electrode for selecting the cell C by columns. On the substrate surface, the region in which the main electrodes and the address electrodes intersect will be the screen (display area) ES.

Figure 2:
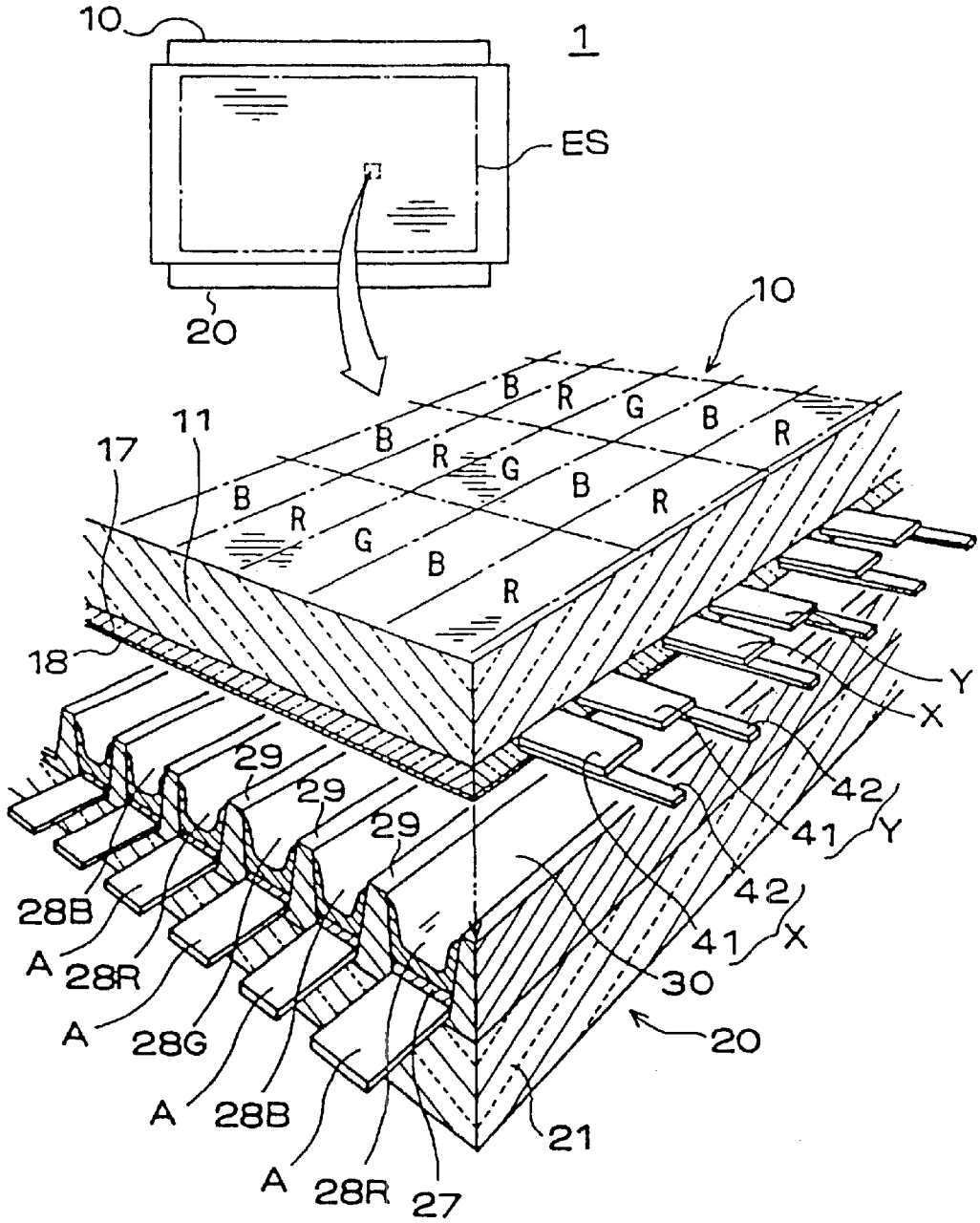
Figure 3A:
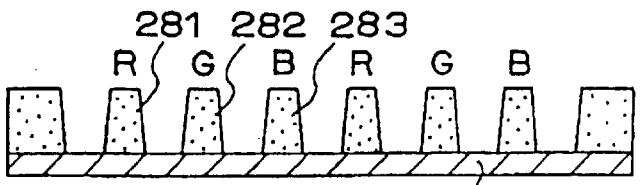
Figure 3B:
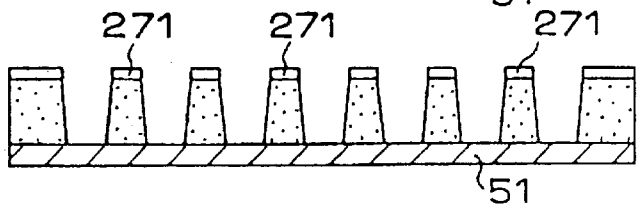
Figure 3C:
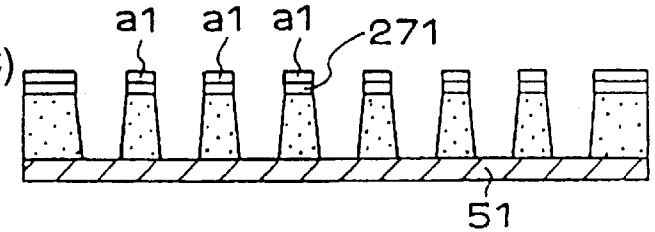
Figure 3D:
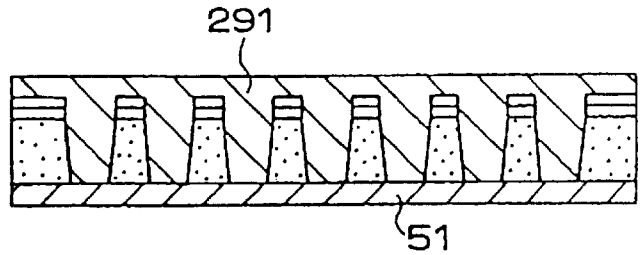
Figure 3E:
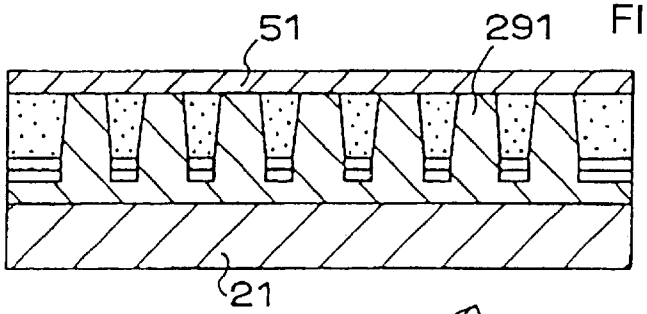
Figure 3F:
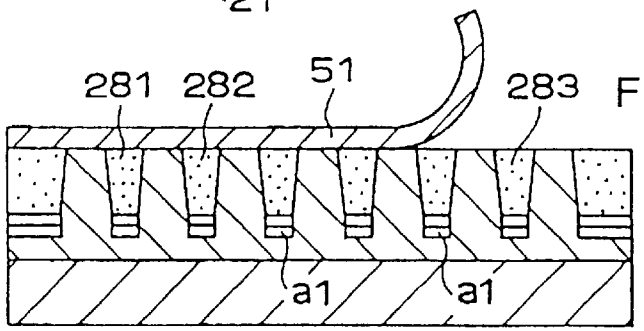
Figure 3G:
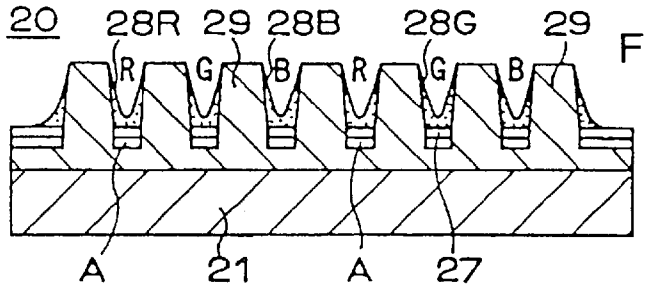

FIG. 2 is an exploded perspective view illustrating the inner structure of the PDP according to the present invention.

The PDP 1 comprises a pair of panel assemblies 10 and 20. In the PDP 1, the main electrodes X and Y are arranged along the line direction in pairs on an inner surface of a glass substrate 11, a base of the panel assembly 10 which serves as a front panel. The line signifies a line of the cells in the horizontal direction. The main electrodes X and Y are made of a transparent electroconductive film 41 and a metal film (bus conductor) 42, respectively and coated with a dielectric layer 17 of about 30 $\mu$m thick. A protective film 18 having a thickness of several thousands angstrom made of magnesia (MgO) is provided on the surface of the dielectric layer 17. The address electrodes A are arranged on an inner surface of a glass substrate 21, a base of the panel assembly 20 which serves as a rear panel and an upper surface thereof is covered with an insulating layer 27. Barrier ribs 29 that are straight belt-shaped in plan view each having a height of 150 $\mu$m are provided between the address electrodes A. The barrier ribs 29 divide discharge spaces 30 by columns along the line direction and define the size of the discharge spaces 30. Fluorescent layers 28R, 28G and 28B of three colors, R, G and B, for color display are provided to cover the inner surface of the rear panel, including regions above the address electrodes A and on the sidewalls of the barrier ribs 29. In the discharge spaces 30, a discharge gas prepared by mixing xenon into neon which is a main material is filled. The fluorescent layers 28R, 28G and 28B are locally excited by ultraviolet rays released by xenon during discharge to emit light. A pixel (picture element) for display is constructed of three subpixels arranged in the line direction. The subpixels are constructed of the cells, respectively. Since the barrier ribs 29 are arranged in stripes, the discharge spaces 30 in each column extend in the column direction over the whole lines.

The PDP 1 uses the address electrodes A and the main electrodes Y at the addressing for setting on/off of the light emission of the cells. That is, screen scanning is performed by applying a scan pulse to the main electrodes Y of N (N is the number of lines) one by one. A desired electrified condition is established in each line by the opposite discharging (address discharging) between the main electrode Y and the address electrode A selected in accordance with the display content. After the addressing, a sustain pulse of a desired crest value is alternatively applied to the main electrodes X and Y. Then, surface discharge occurs along the substrate surface in a cell where a proper amount of wall charge exists after the addressing. As a result, the fluorescent layers 28R, 28G and 28B emit light.

The PDP 1 as constructed above is manufactured by a set of steps of: providing required constituents separately with the glass substrates 11 and 21 to prepare the panel assemblies 10 and 20 which serve as the front panel and the rear panel, respectively; coupling the panel assemblies 10 and 20; sealing the circumference of the assemblies facing each other; discharging air from the inside; and filling therein the discharge gas. Hereinafter, how to manufacture the panel assembly 20 in accordance with the present invention will be explained.

First Embodiment

FIG. 3 shows the manufacturing steps according to First Embodiment.

(A) On a surface of a support body 51 which is not the glass substrate 21, walls of three kinds 281, 282 and 283 made of a fluorescent material that are belt-shaped in plan view are arranged in stripes. The method of manufacturing the walls will be described later. The walls 281, 282 and 283 correspond to the above-mentioned fluorescent layers 28R, 28G and 28B, respectively, and their arrangement pitch is the pitch of the cells in the line direction. The height of the walls 281 through 283 is selected to obtain the barrier ribs 29 of a desired height while taking shrinkage at the firing into consideration. Specifically, the height may be about 200 $\mu$m. The fluorescent material is a mixture containing fluorescent particles and an organic binder, which is added with a photosensitive agent, a plasticizer for giving plasticity and a substance for adjusting the shape obtained after the firing (dispersing agent or binder) depending on the formation method.

(B) An insulating layer 271 is formed on the walls 281, 282 and 283. That is, a low melting glass, ceramics, or a mixture of solid powder containing these materials with an organic binder is applied using a roll coater or a screen. At this time, dilution with a solvent is performed to control the thickness of the layer. This step is performed to isolate the address electrode from the fluorescent layer or to provide a dielectric layer on the rear panel. If the insulating layer 27 is not required in consideration of the structure of the PDP, this step is omitted. The isolation of the address electrode from the fluorescent layer is required in the case where the electrode material is dispersed in the fluorescent material, or the case where insulation strength between the electrodes is lowered.

(C) An electrode material layer a1 is formed over the insulating layer 271 on the walls 281, 282 and 283. For example, an electroconductive paste as typified by silver paste is applied. However, if the electrodes have been formed on a substrate on which the transfer is to be performed, the step of forming the electrode material layer is not required.

(D) A barrier rib material 291 is applied to fill spaces (belt-shaped grooves in plan view) between the walls 281 through 283. When it is applied to cover the electrode material layer a1 as illustrated, the spaces can surely and easily be filled up. However, it may also be possible to apply the barrier rib material 291 with the amount for filling the grooves exactly. That is, it is not always necessary to cover the upper surface of the electrode material layer a1. As the barrier rib material, can be used are low melting glass, ceramics, or a mixture of solid powder containing these materials with an organic binder. A plasticizer for giving plasticity and a substance for adjusting the shape after the firing (dispersing agent or binder) may be added thereto.

(E) The support body 51 and the glass substrate 21 are coupled so that the barrier rib material 291 and the glass substrate 21 face to each other. Then the layered body provided in the steps (A) through (D) is transferred from the support body 51 to the glass substrate.

(F) The support body 51 is removed.

(G) The barrier rib material 291, the electrode material layer a1 and the walls 281 through 283 are fired in one step to form the barrier ribs 29, the address electrodes A and the fluorescent layers 28R, 28G and 28B. In this step, the insulating layer 27 is formed simultaneously.

According to the manufacturing method as described above, the barrier ribs, 29, the address electrodes A and the fluorescent layers 28R, 28G and 28B are self-aligned. Therefore, high quality display can be realized without depending on an advanced alignment technique.

In the description above, the layered body on the support body is constructed of the fluorescent material, the electrodes, (the insulating layer) and the barrier ribs. However, it may also be possible to preliminarily form the electrodes on the substrate and the layered body constructed of the fluorescent material, (the insulating layer) and the barrier ribs may be transferred to the substrate. (In this case, the formation of the electrode material layer is not required for preparing the layered body as mentioned in the step (C).)

Figure 5B:
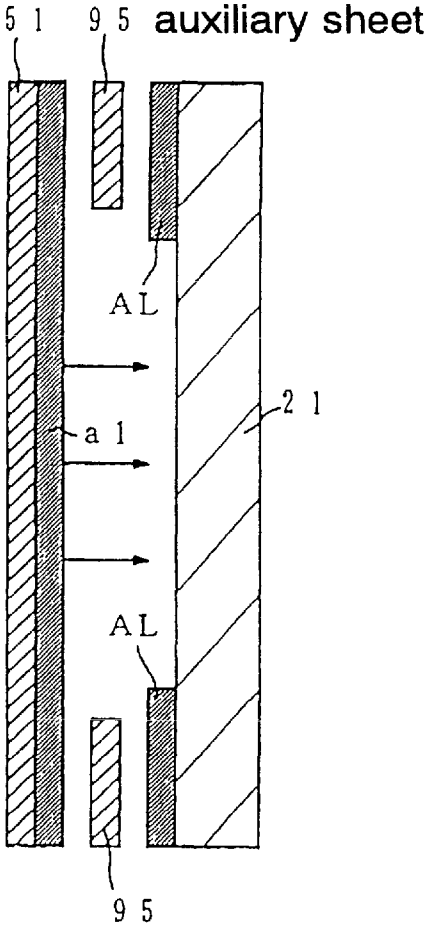
Figure 5A:
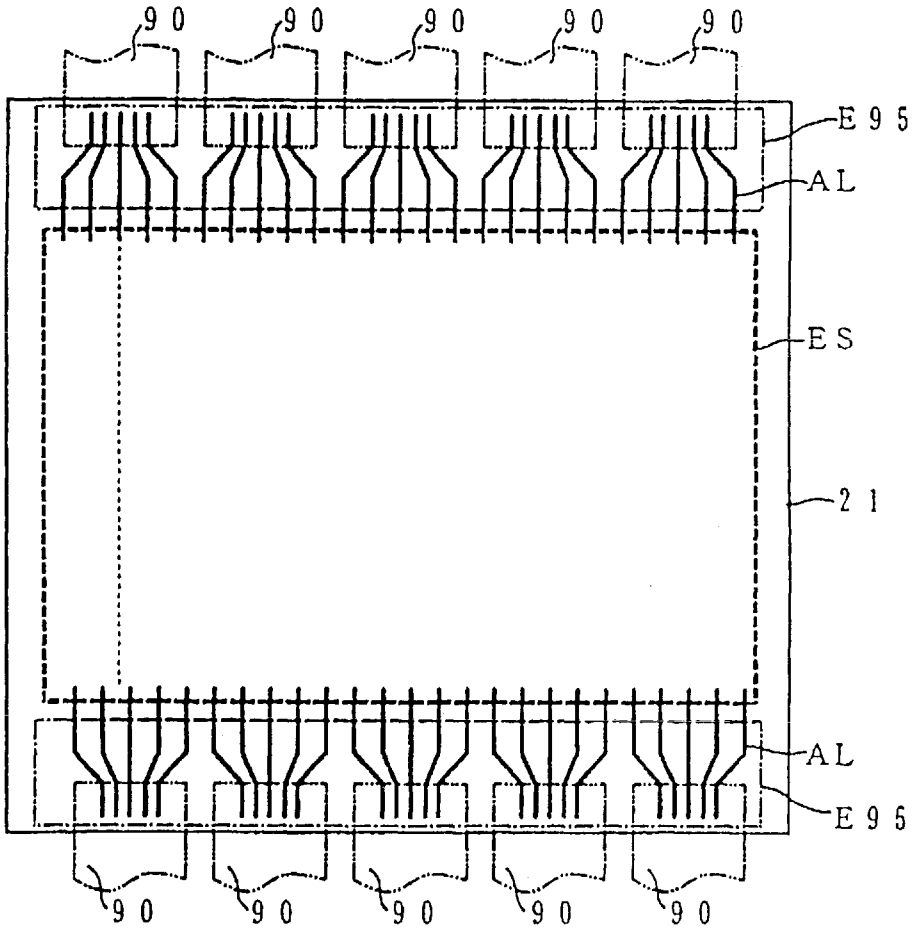

FIG. 5 is a view illustrating how to transfer in the case where the electrodes are separately formed.

Regarding the connection between the PDP and a driving circuit, the address electrodes A are connected to flexible cables 90 at the edges in the column direction of the glass substrate 21. For connecting the flexible cable 90 with high reliability, pressure bonding is performed after dividing the address electrodes A into groups of about four to six. For example, where the screen ES is of XGA type, the total number of the address electrodes is 1024×3. Accordingly, where connection terminals are arranged at the edges in the column direction, the number of the address electrodes in one group is about 250 to 400. Since a plurality of the flexible cables 90 are arranged along the line direction, the arrangement pitch of the connection terminals is smaller than that of the address electrodes in the screen ES. Therefore, outgoing wirings AL prepared by suitably curving the address electrodes A are provided.

In the method shown in FIG. 5, only portions of the address electrodes A corresponding to the outgoing wirings AL are preliminarily formed on the glass substrate 21 and other portions are transferred from the support body 51. The electrode material layer a1 of straight belt shape are formed on the support body 51. As mentioned below, this facilitates the sequential formation of a plurality of layered bodies for the plural panel assemblies on the support body in the sheet form. It is also possible to provide the electrode material layer a1 in a region corresponding to the screen ES. However, as shown in FIG. 5(*b*), it is more productive to provide the layered body including the electrode material layer a1 on a large region overlapping the outgoing wirings AL and then transfer the electrode material layer a1 only to a necessary region by using an auxiliary sheet 95. A region E95 at the outer periphery of the screen ES is covered with the auxiliary sheet 95 while exposing a part of the outgoing wirings AL which will overlap with the electrode material layer a1 in order to partially prevent the transfer of the layered body (transfer layer) including the electrode material layer a1 and the walls on the support body 51. At the transfer, alignment of the electrode material layer a1 and the outgoing wirings AL is performed.

Figure 6A:
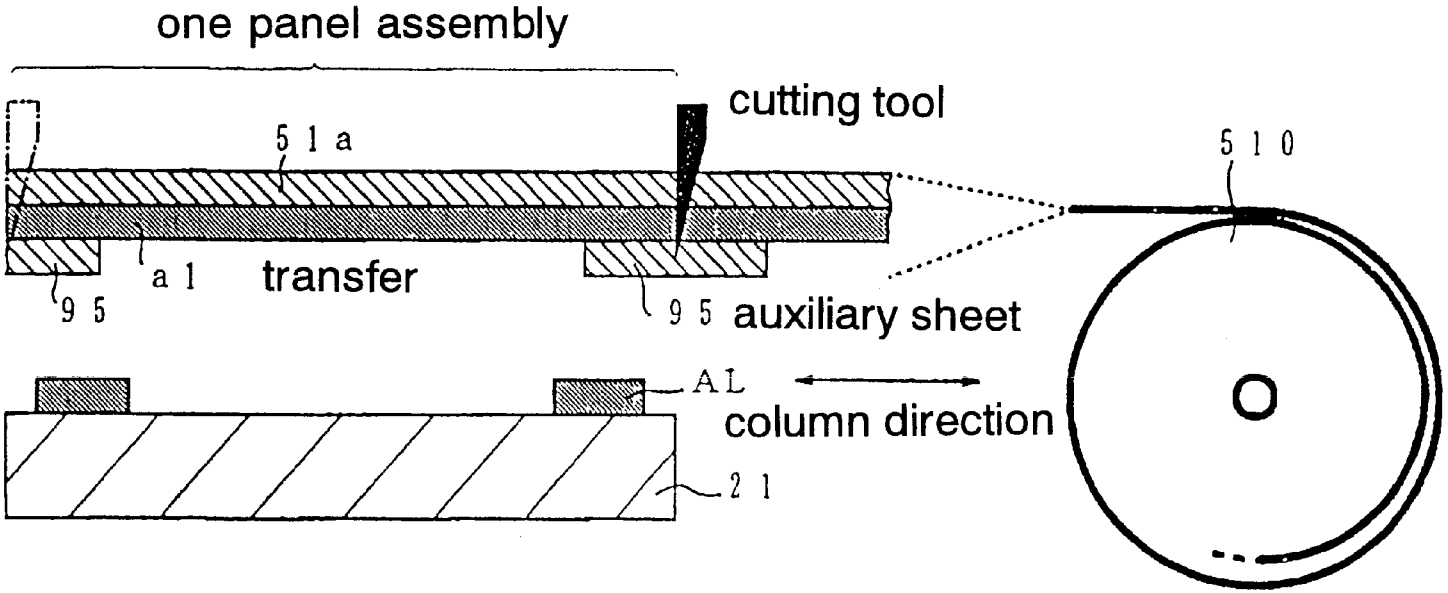
Figure 6B:
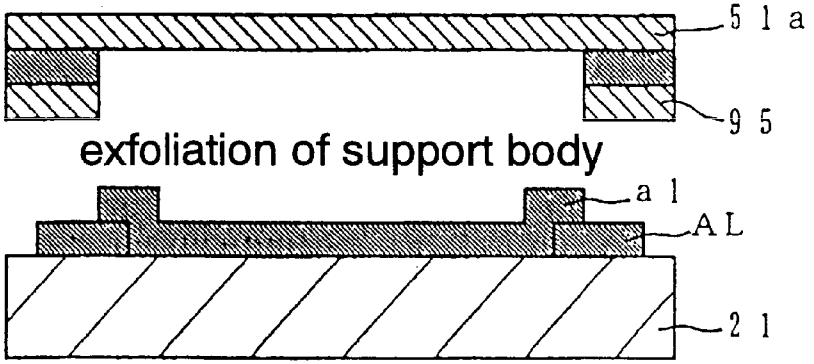

FIG. 6 is a schematic view illustrating how to perform the transfer utilizing the transfer material sheet.

The layered body (transfer layer) is sequentially formed in accordance with the steps (A) to (D) shown in FIG. 3 on a flexible body (e.g., a polyethylene film) of a sufficient length having a width corresponding to the length of the glass substrate 21 in the line direction. Then, the flexible body on which the layered body has been formed is rolled with the auxiliary sheet 95 and a cover film which is not shown. Thus, a transfer material sheet 510 is prepared.

A desired length of the transfer material sheet 510 is pulled out to be laid over the glass substrate 21 having the outgoing wirings AL. After or immediately before the sheet is laid, the transfer material sheet 510 is cut. The cut flexible body corresponds to a support body 51*a* of the present invention. The transfer material sheet 510 is press-bonded onto the glass substrate 21 using a laminator to transfer the layered body including the electrode material layer a1 to the glass substrate 21. It may be heated during the press bonding, if necessary.

FIG. 7 shows a view illustrating a variety of the firing step.

In the example shown in FIG. 3, the firing is performed after the removal of the support body 51. However, where a flammable support body 51*b* is used, it is possible to obtain a panel assembly 20*b* which serves as a rear panel even if the firing is performed with the support body 51*b* left attached. By selecting, as the support body 51*b*, a material which is thermally decomposed (burned out) at a temperature lower than a firing temperature for the barrier ribs 29 and the fluorescent layers 28R, 28G and 28B, the removal of the support body 51*b* is omitted and thus the number of steps can be reduced. Further, the requirement of easy exfoliation will be unnecessary. The adhesion power of the support body 51*b* to the layered body is sufficient as long as it is maintained during the patterning. Examples of the support body include an acrylic resin having a molecular weight equal to or smaller than that of an organic binder used in the fluorescent material and the rib barrier material, and a self-subliming organic material as typified by nitrocellulose.

Figures 8A, 8B, 8C, 8D, 8E, 8F, 8G, 8H:
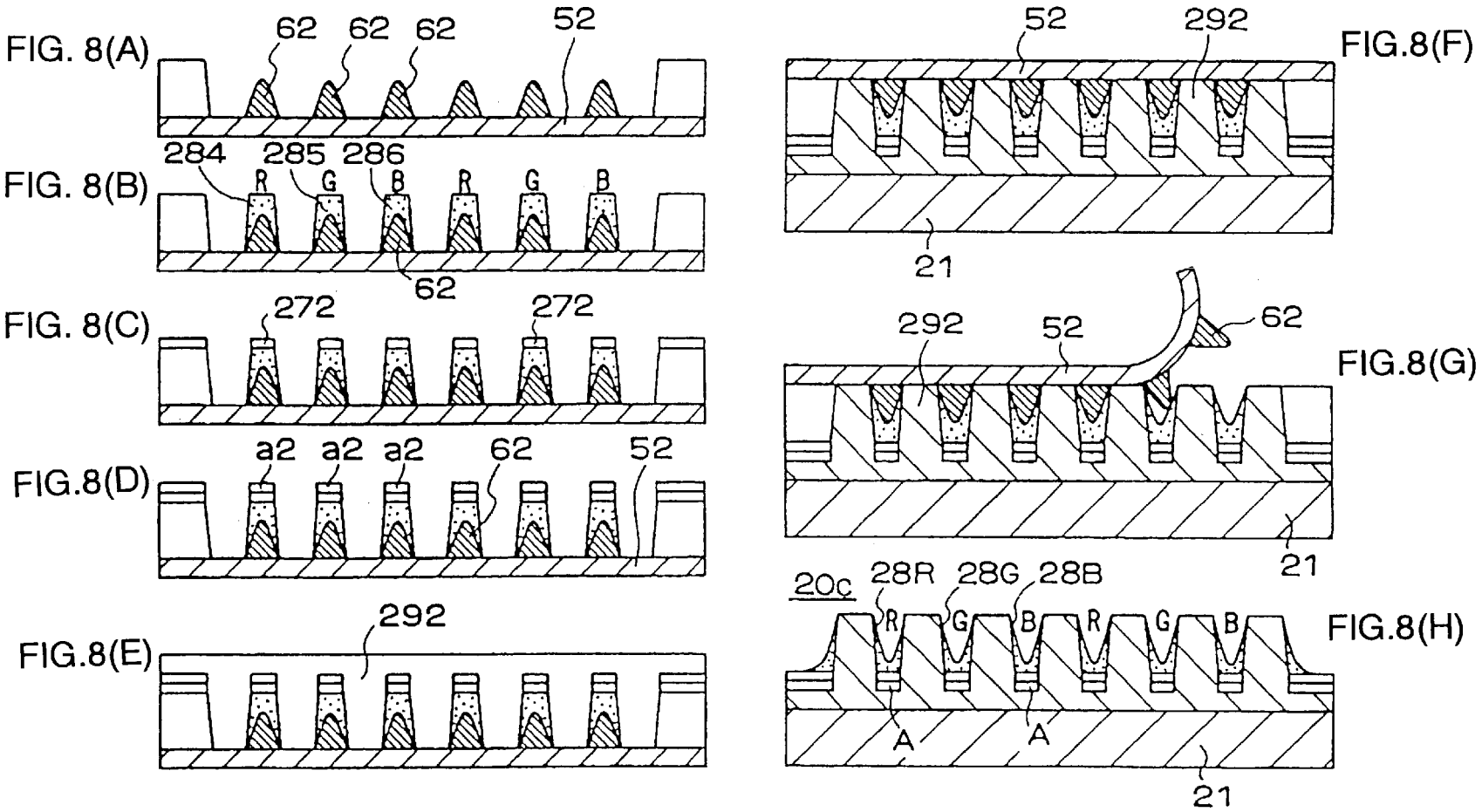

FIG. 8 shows the manufacturing steps according to Second Embodiment.

An object of the present embodiment is to forcibly adjust the cross sectional shape of the fluorescent layers 28R, 28G and 28B.

(A) Projections 62 that are belt-shaped in plan view are formed in a region for forming the fluorescent layer on a support body 52.

(B) Walls 284, 285 and 286 of three kinds made of a fluorescent material that are belt-shaped in plan view are arranged in stripes on the projections 62.

In the same manner as in the First Embodiment shown in FIG. 3, (C) an insulating layer 272 is formed on the walls 284 through 286, (D) an electrode material layer a2 is formed on the insulating layer 272, (E) a barrier rib material 292 is applied to fill spaces between the walls 284 through 286 adjacent to each other, (F) the layered body is transferred from the support body 52 to the glass substrate 21, (G) the support body 52 and the projections 62 are removed, and then (H) the firing is performed to obtain a panel assembly 20*c* having the barrier ribs 29, the address electrodes A and the fluorescent layers 28R, 28G and 28B.

By forming the projections 62, the cross sections of the walls 284 through 286 become similar to those to be obtained after the firing. A percentage of the filled fluorescent material increases so that dense fluorescent layers 28R, 28G and 28B can be formed. Further, great shrinkage by the firing and a large concentration of the fluorescent material, which are conditions required to the fluorescent material contrary to each other, can be satisfied.

Figures 9A, 9B, 9C, 9D, 9E, 9F:
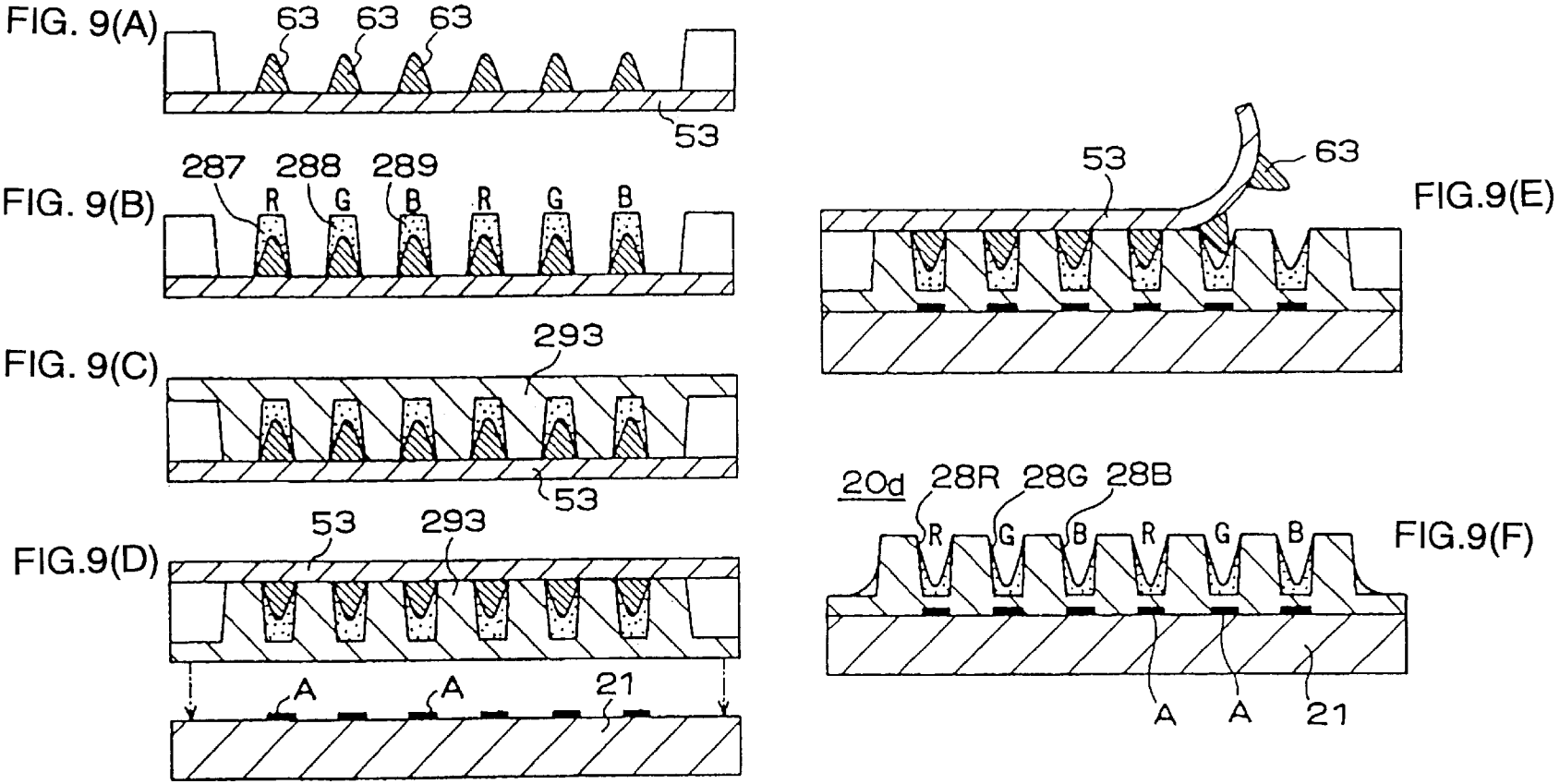

FIG. 9 shows the manufacturing steps according to Third Embodiment.

The present embodiment is to provide, on the glass substrate 21, the address electrodes A or the electrode material layer patterned corresponding to the address electrodes A.

(A) Projections 63 that are belt-shaped in plan view are formed in a region for forming the fluorescent layer on a support body 53. This step may be omitted.

(B) Walls 287, 288 and 289 of three kinds made of a fluorescent material that are belt-shaped in plan view are arranged in stripes on the projections 63.

Figure 4:
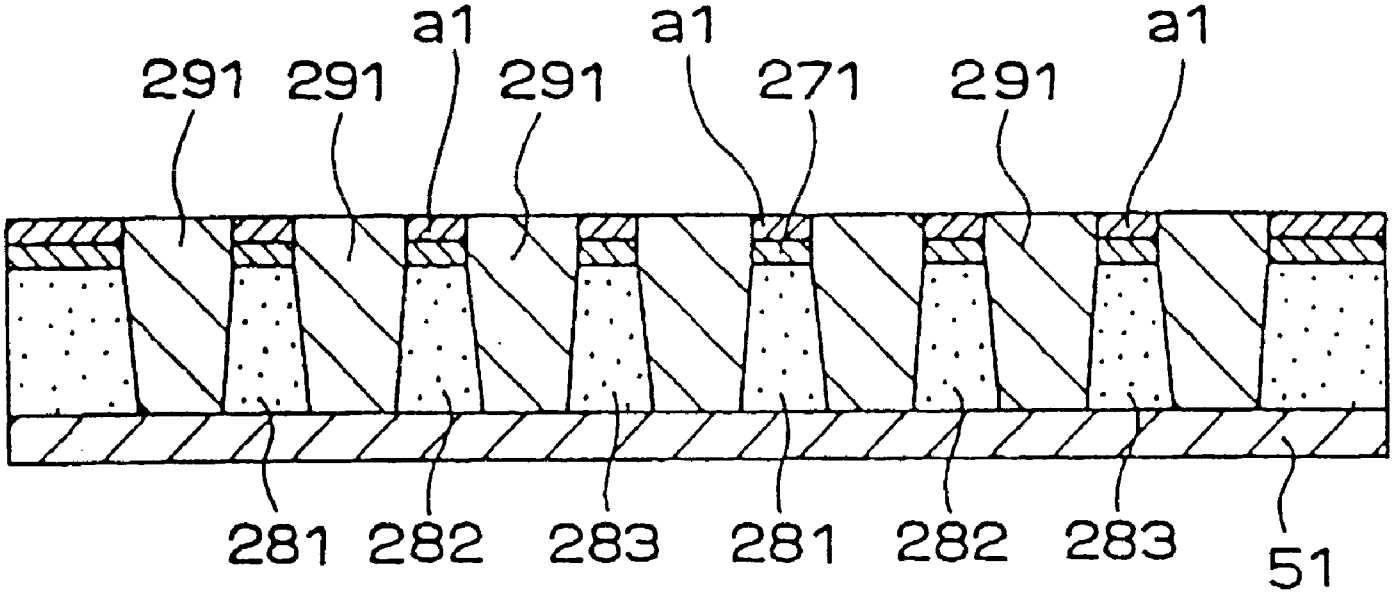

(C) A barrier rib material 292 is applied to fill spaces between the walls 287 through 289 adjacent to each other. By applying it to cover the walls 287, 288 and 289, the spaces can be easily and surely filled up and a particular step of forming an insulating layer 27 can be omitted. Alternatively, a barrier rib material 293 may be applied with the amount for filling the spaces exactly as in the case shown in FIG. 4.

(D) The layered body is transferred from the support body 53 to the glass substrate 21 on which the address electrodes A have been provided.

(E) The support body 53 and the projections 63 are removed.

(F) The firing is performed in one step to obtain a panel assembly 20*d* including the barrier ribs 29, the address electrodes A and the fluorescent layers 28R, 28G and 28B.

Figure 10:
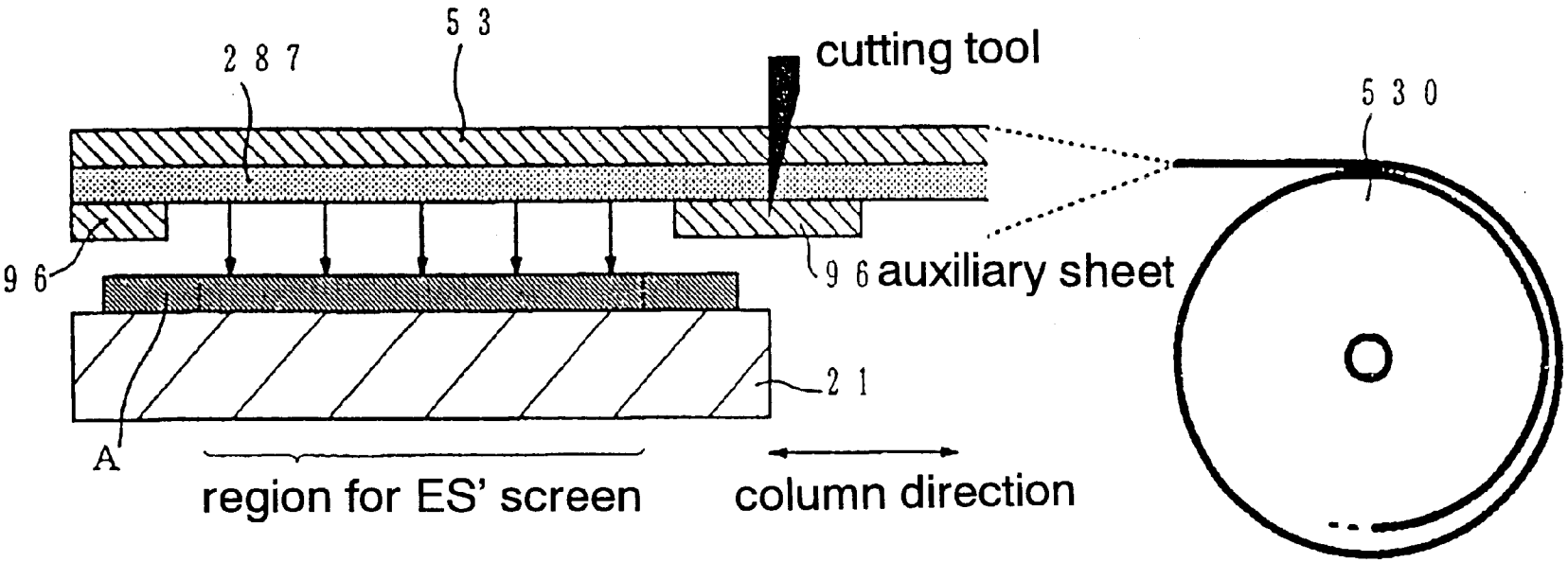

FIG. 10 is a schematic view illustrating how to perform the transfer using the transfer material sheet.

Also in the case where the electrodes are preliminarily formed on the glass substrate 21, the productivity can be enhanced by preparing a transfer material sheet 530 in the rolled shape as in the case shown in FIG. 6. By providing an auxiliary sheet 96 when the transfer material sheet is rolled, the layered body including the walls 287 is transferred only to a desired region ES' on the glass substrate 21.

FIG. 11 shows a variety of the firing step.

By forming a support body 53*a* and projections 63*a* with a flammable material, the firing is performed without removing them and a panel assembly 20*e* which serves as a rear panel can be obtained.

Figures 12A, 12B, 12C:
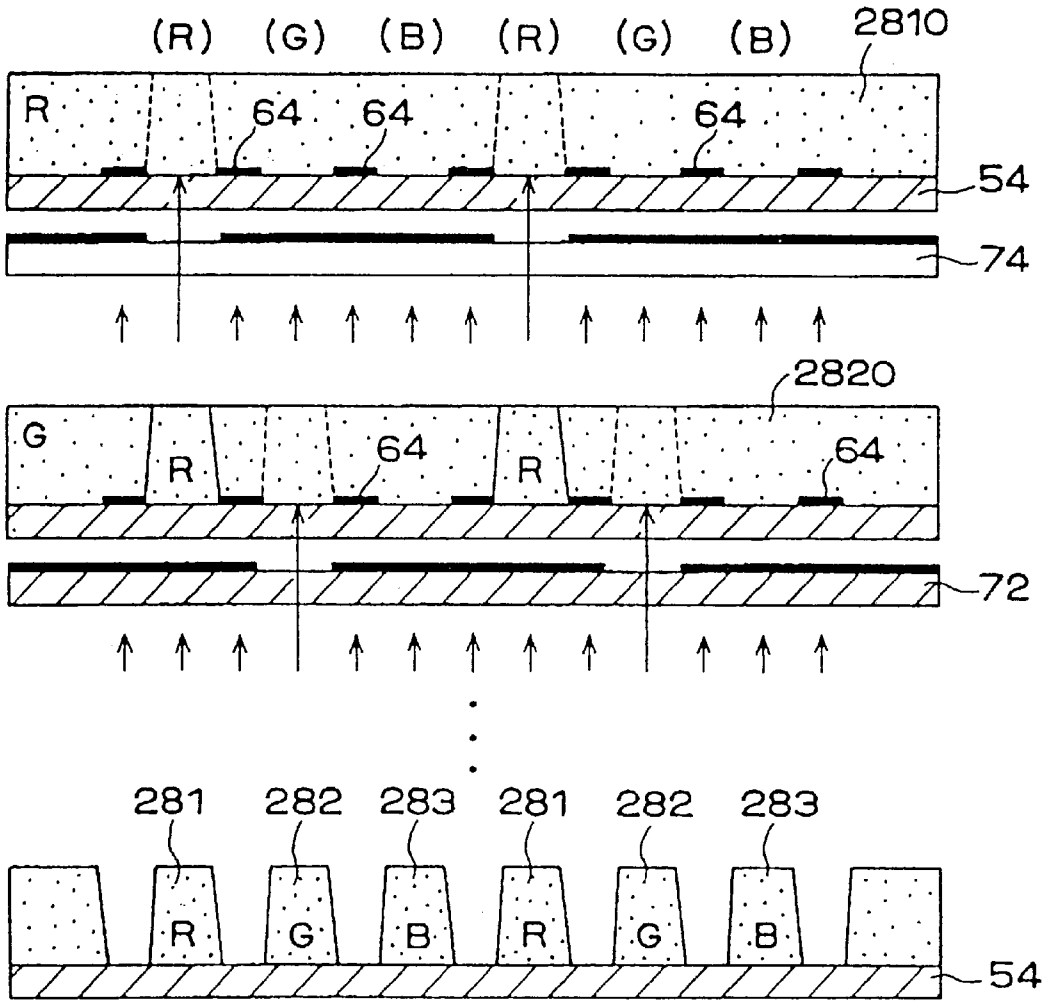

FIG. 12 shows the first example of the formation of the walls made of a fluorescent material.

(A) On a light-transmissive support body 54, provided is a lightproof pattern 64 made of emulsion or a thin film having openings in regions for forming the fluorescent layers 28R, 28G and 28B. A photosensitive fluorescent material 2810 of the first color (R) is uniformly applied. A lightproof mask 71 having openings in regions for forming the R-colored fluorescent layer 28R is provided on a rear surface of the support body 54 to perform light exposure from the rear surface to the entire surface. With the openings of the lightproof mask 71 greater than those of the lightproof pattern 64, the alignment of the lightproof mask 71 is facilitated. Since the lightproof pattern 64 adheres to the photosensitive fluorescent material 2810, the patterning can be performed accurately without any influence of the thickness of the support body 54 and the clearance between the lightproof mask 71 and the support body 54. Further, since the light exposure is performed from the rear surface, the adhesion between the support body 54 and the lightproof mask 71 is improved and the cross sectional shape of the walls can be adjusted making use of the decrease of the amount of light.

As the method of applying the photosensitive fluorescent material on a support body in the sheet form, may be employed a method of dropping a fluorescent material onto the sheet running on a platen and forming it into a thin film with a doctor blade, or a method utilizing a roll coater or a slot coater. It may be possible to laminate a sheet of the photosensitive fluorescent material. As to the light exposure, it may be possible to perform laser drawing in place of proximity light exposure. By this method, patterning into a desired configuration is easily performed. With respect to the development, spray development is suitable. Thus, with the support body in the sheet form, the walls can be sequentially provided.

(B) After developing the photosensitive fluorescent material 2810 of R, a photosensitive fluorescent material 2820 of the second color (G) is uniformly applied. A lightproof mask 72 having openings in regions for forming the G-colored fluorescent layer 28G is formed on the rear surface of the support body 54 to perform the light exposure to the entire surface. In this step, the lightproof mask 71 may be offset along the line direction to serve as the lightproof mask 72.

(C) In the similar manner, a photosensitive fluorescent material layer of the third color (B) is applied and patterned by photolithography. Thus, the walls 281 through 283 are obtained.

Figure 13A:
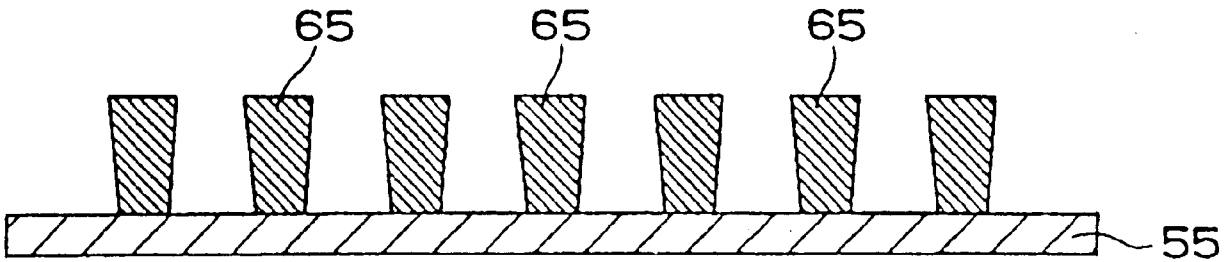
Figure 13B:
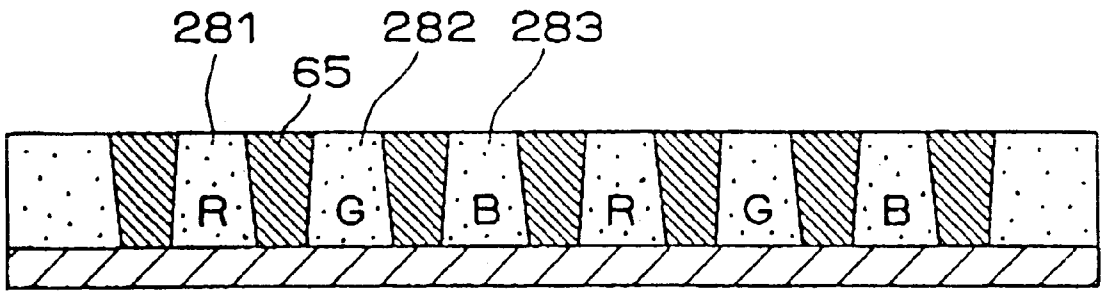
Figure 13C:
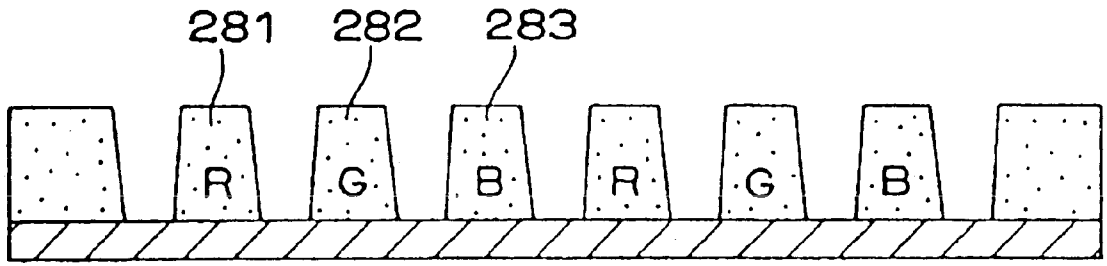

FIG. 13 shows the second example of the manufacturing method of the walls made of the fluorescent material.

(A) Dummy walls 65 patterned as a negative of the walls 281 through 283 are formed on a support body 55.

(B) A fluorescent material of desired color is filled in spaces between the dummy walls 65. A dispenser is suitably used for filling the fluorescent material.

(C) The dummy walls 65 are removed by a suitable method, e.g., etching, sand blast, cutting with a cutting tool and the like.

Figure 14:
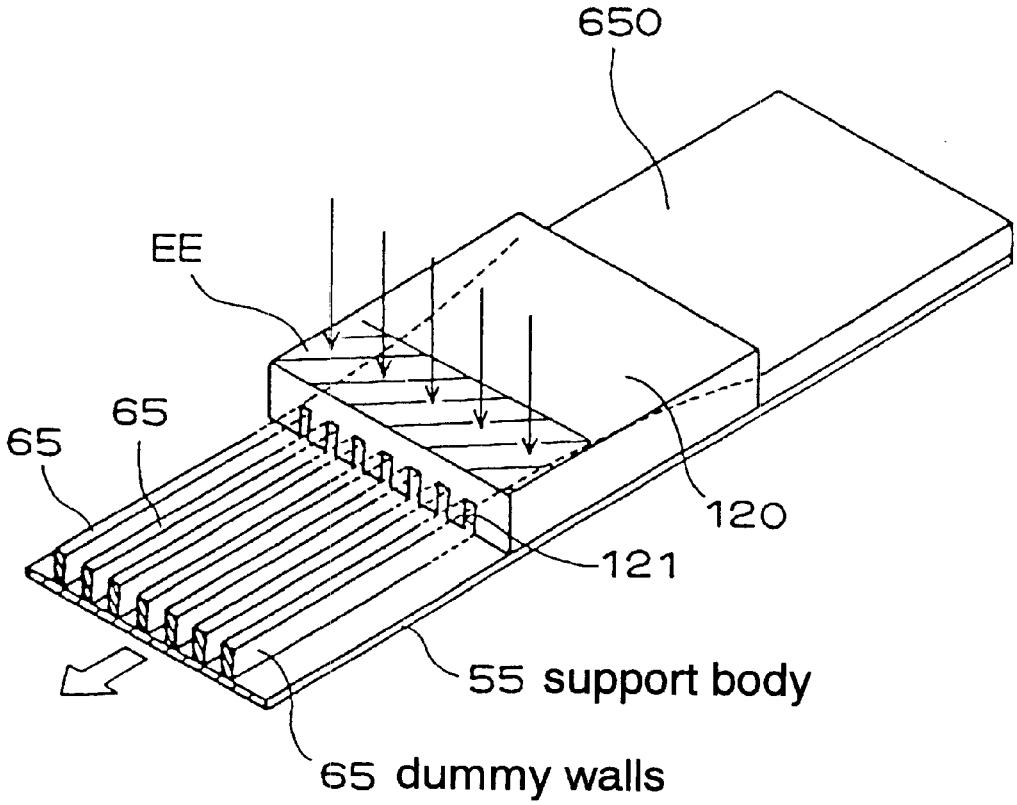

FIG. 14 shows the first example of the formation of the dummy walls.

A photosensitive material 650 (e.g., a UV curing resin) is uniformly applied to a support body 55 with a technique using a doctor blade or the like. A light-transmissive jig 120 with grooves 121 of a certain configuration is laid on the support body 55. The support body 55 is then pulled in the lengthwise direction of the grooves, thereby shaping the photosensitive material 650 with the grooves 121. The light exposure is performed at a region EE near the outlets of the grooves 121 where the shaped photosensitive material comes out, thereby curing the shaped photosensitive material 650. Since the application, shaping and light exposure of the photosensitive material 650 can be performed in sequence, this method can be applied to the manufacture of the above-mentioned transfer material sheet.

The projections 62 and 63 illustrated in FIGS. 8 and 9 can also be formed in the similar manner.

Figure 15:
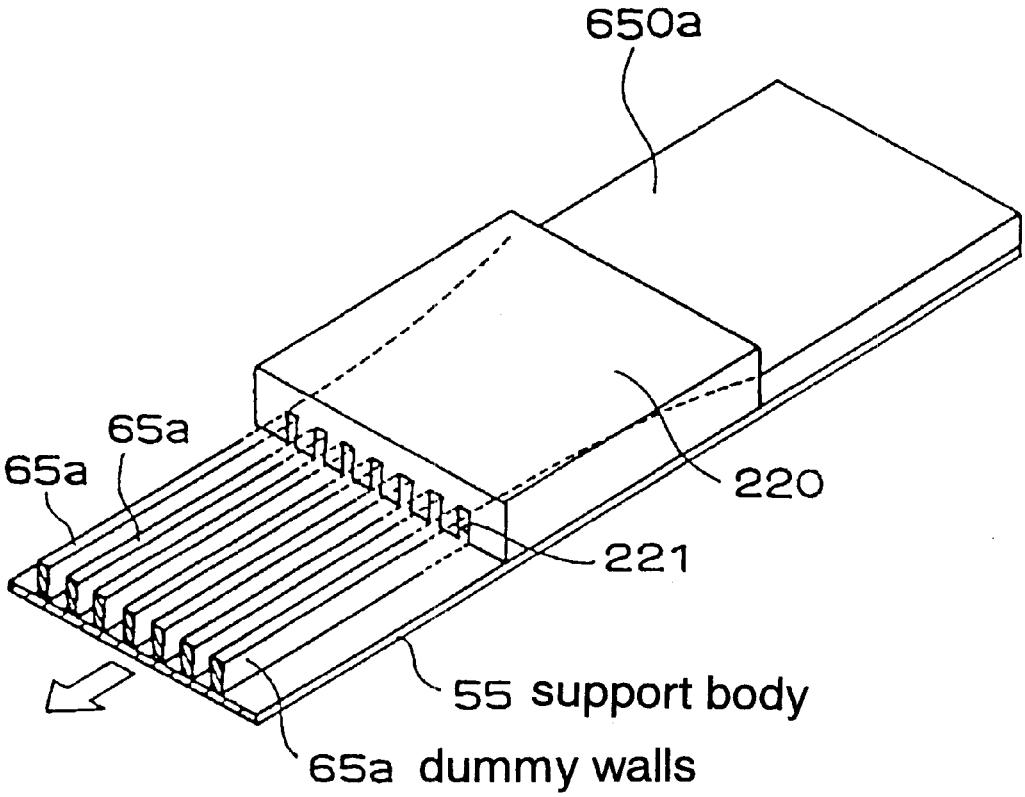

FIG. 15 shows the second example of the formation of the dummy walls.

In the same manner as in the first example described above, a jig 220 having grooves 221 is used to shape a uniformly applied material 650*a* into a desired configuration by mechanical pressure. With suitably selected strength, the shaped material 650*a* can be used as dummy walls 65*a* without curing. For easier shaping, the jig 220 or the support body may be heated, or the material 650*a* is preliminarily warmed and cooled during the shaping. This method can also be applied to the formation of the transfer material sheet.

As another method of forming the walls 281 through 283 made of the fluorescent material, there is a method of quantitatively dropping a paste using a jig provided with a dispenser or slits. Fluorescent pastes of different colors are separately discharged to form the pattern from corresponding discharge outlets of the dispenser or slits opened in portions corresponding to the color difference. In order to prevent deformation of the pattern due to dripping of the paste, it is preferable to form the pattern by dropping a paste of high thixotropy and then applying thereon another paste containing a solvent to be absorbed in the pattern to ensure the height of the pattern. In the case of using the dispenser, a plurality of dispensers may be arranged along the line direction, or if this arrangement is impossible in view of pitch, they may be shifted backwards and forwards or arranged diagonally. As the jig having the slits, a screen plate used in screen printing or a common screen printing may be employed. The printing plate usable may be a screen mesh plate, a metal plate without the mesh and the like.

The pastes of three colors are simultaneously discharged from the slits or the openings arranged in a certain pitch to form fluorescent material layers arranged in stripes adjacent to each other, and then boundary portions of the different colored layers are shaved. This method is excellent in productivity. When this method is employed, it is desirable to suitably select the amount and the material of the fluorescent layers so that the layers of different colors are not mixed, or use a quick-drying solvent. Shaving means may be a dicing saw or a cutting tool for grinding. In this case, it is the most preferable way to use a plurality of shaving means to improve the operation tact. As a supplementary method for the formation of the walls, the sidewalls, the top surfaces or the surfaces between the walls are polished with a brush or a microscopic whetstone. Burrs of the walls and residues between the walls can be removed with the brush. A whetstone having a convex portion corresponding to a negative configuration of the walls is used for polishing the sidewalls of the walls, if required. Such a whetstone can be prepared by applying a material in which a polishing agent is dispersed in an organic vehicle onto a surface of a metal-finished mold. Such a polishing for the configuration adjustment can also be applied to the above-mentioned dummy walls 65 and 65*a*.

It is also possible to use a water-soluble material (e.g., PVA) as the material of the dummy walls 65 and 65*a* and a nonaqueous binder material (e.g., an acrylic resin) as the fluorescent material.

Dispenser method can be employed as another method of forming the dummy walls 65 and 65*a*. In this method, the paste is discharged from an outlet of the dispenser. In order to prevent deformation of the pattern due to dripping of the paste, it is preferable to form the pattern by dropping a paste of high thixotropy and then applying thereon another paste containing a solvent to be absorbed in the pattern to secure the height of the pattern.

In the above embodiments, the auxiliary sheets 95 and 96 are used to prevent the transfer to the outgoing wirings AL. However, regarding the outer periphery of the screen ES, it may be possible to form walls and the barrier rib material of the same configuration as the outgoing wirings AL and remove the barrier ribs 29 and the fluorescent layers 28R, 28G and 28B covering the outgoing wirings AL after the firing, thereby exposing the outgoing wirings AL.

The formation steps can suitably be changed within the range of the spirit of the present invention. The present invention can also be applied to the formation of the panel assembly for other display panels than the surface discharge type PDP.

According to the above-mentioned embodiments, the alignment-free between the barrier ribs and the fluorescent layers is achieved and the waste of the barrier rib material is minimized for cost reduction. Further, the alignment-free among the electrodes, the barrier ribs and the fluorescent layers is also achieved.

Still further, the manufacturing time and steps per one panel assembly can be reduced by forming plural panel assemblies in sequence.

As a result, a less expensive display panel can be provided.

What is claimed is:

1. A method of manufacturing a panel assembly used to assemble a display panel having at least a plurality of barrier ribs that are belt-shaped in plan view for dividing the screen by columns, a plurality of electrodes for selecting the column, and a fluorescent layer that is belt-shaped in plan view extending along sidewalls of the barrier ribs and above the electrodes in each column provided on a substrate greater than a desired screen, the method comprising:

forming a plurality of walls made of a fluorescent material that are belt-shaped in plan view so that the walls are arranged in stripes on a support body which is not the substrate;

forming an electrode material layer on the walls;

filling a barrier rib material in a space between the walls;

coupling the substrate and the support body so that the barrier rib material faces the substrate; and transferring the walls, the electrode material layer and the barrier rib material to the substrate in one step, thereby to form the barrier ribs, the electrodes and the fluorescent layer.

2. A method according to claim 1, wherein the walls, the electrode material layer and the barrier rib material are fired in one step after they are transferred to the substrate and the support body is removed.

3. A method according to claim 2, wherein a body whose surface is coated with a resin is used as the support body so that the support body is exfoliated from the substrate while the resin is softened.

4. A method according to claim 1, wherein a flammable material is used as the support body so that the support body is burned out when the walls, the electrode material layer and the barrier rib material are fired in one step after they are transferred to the substrate.

5. A method according to claim 1, wherein the electrode material layer is formed after an insulating layer is formed on the walls.

6. A method according claim 1, wherein, prior to the coupling with the support body, outgoing wirings are formed on an edge of the substrate for connection between the electrodes and external circuits, and the electrode material layer and the outgoing wirings are aligned when the substrate and the support body are coupled.

7. A method according to claim 6, wherein at least a part of the outgoing wirings is covered with an auxiliary sheet, and the auxiliary sheet is removed after the walls, the electrode material layer and the barrier rib material are transferred to the substrate.

8. A method according to claim 1, wherein a body having projections that are belt-shaped in plan view in a region for forming the walls is used as the support body, and the walls are formed on the projections.

9. A method according to claim 8, wherein the projections are provided by forming a photosensitive material on the support body using a device provided with grooves configured to correspond to the shape of the projections and performing light exposure.

10. A method according to claim 1, wherein a flexible film which can be rolled is used as the support body.

11. A method according to claim 1, wherein a rigid material is used as the support body.

12. A method according to claim 1, wherein an elastic material is used as the support body.

13. A method according to claim 1, wherein the walls are formed by photolithography using a photosensitive fluorescent material.

14. A method according to claim 13, wherein the walls are formed by providing the support body made of a light-transmissive material, forming a lightproof layer having openings in a region for forming the walls on the support body, forming a mask having openings arranged in different pitch from those of the lightproof layer on a rear surface of the support body, and performing one or more light exposure step from the rear surface to a part of the fluorescent material which is applied uniformly on a front surface of the support body for development.

15. A method according claim 1, wherein the walls are formed by applying the fluorescent material using a device having a discharge outlet configured to correspond to the cross section of the walls.

16. A method according to claim 15, wherein the walls are formed by simultaneously applying plural kinds of fluorescent materials which emit lights of different colors and removing a portion around a boundary between the applied fluorescent material layers of different kinds.

17. A method according to claim 1, wherein a processing treatment for adjusting the shape of the walls is performed.

18. A method according to claim 1, wherein the walls are provided by forming dummy walls configured to correspond to the barrier ribs on the support body, and filling a space between the dummy walls with the fluorescent material and then removing the dummy walls.

19. A method according to claim 18, wherein the dummy walls are formed of a water-soluble material so that the dummy walls are removed by dissolving into water.

20. A method according to claim 18, wherein the dummy walls are formed by applying a photosensitive material using a device provided with grooves configured to correspond to the dummy walls and performing light exposure.

21. A method according to claim 18, wherein a processing treatment for adjusting the shape of the dummy walls is performed.

22. A method of manufacturing a panel assembly used to assemble a display panel having at least a plurality of barrier ribs that are belt-shaped in plan view for dividing the screen by columns, a plurality of electrodes for selecting the column, and a fluorescent layer that is belt-shaped in plan view extending along sidewalls of the barrier ribs and above the barrier ribs in each column provided on a substrate greater than a desired screen, the method comprising:

forming a plurality of walls made of a fluorescent material that are belt-shaped in plan view so that the walls are arranged in stripes on a support body which is not the substrate;

filling a barrier rib material in a space between the walls;

coupling the substrate on which the electrodes have preliminarily been arranged and the support body so that the barrier rib material faces the substrate; and transferring the walls and the barrier rib material to the substrate in one step, thereby to form the barrier ribs and the fluorescent layer on the substrate.

23. A method according to claim 22, wherein the walls and the barrier rib material are fired in one step after they are transferred to the substrate and the support body is removed.

24. A method according to claim 22, wherein a flammable material is used as the support body so that the support body is burned out when the walls and the barrier rib material are fired in one step after they are transferred to the substrate.

25. A transfer material sheet for manufacturing a panel assembly used to assemble a display panel having at least a plurality of barrier ribs that are belt-shaped in plan view for dividing the screen by columns, a plurality of electrodes for selecting the column, and a fluorescent layer that is belt-shaped in plan view extending along sidewalls of the barrier ribs and above the barrier ribs in each column provided on a substrate greater than a screen, the transfer material sheet comprising:

a plurality of connected support bodies each being provided with a plurality of walls attached thereto made of a fluorescent material that are belt-shaped in plan view arranged in stripes, an electrode material layer covering an upper surface of the walls and a barrier rib material filling a space between the walls, the transfer material sheet being formed of a flexible material in a rolled form to couple the substrate and the support body so that the barrier rib material faces the substrate and to transfer the walls, the electrode material layer and the barrier rib material to the substrate in a single step, to thereby form the barrier ribs, the electrodes, and the fluorescent layer on the substrate.

26. A transfer material sheet according to claim 25, wherein the transfer material sheet is rolled with an auxiliary sheet for partially covering the support body for preventing the transfer.

27. A transfer material sheet for manufacturing a panel assembly used to assemble a display panel having at least a plurality of barrier ribs that are belt-shaped in plan view for dividing the screen by columns, a plurality of electrodes for selecting the column, and a fluorescent layer that is belt-shaped in plan view extending along sidewalls of the barrier ribs and above the barrier ribs in each column provided on a substrate greater than a screen, the transfer material sheet comprising:

a plurality of connected support bodies each being provided with a plurality of walls attached thereto made of a fluorescent material that are belt-shaped in plan view arranged in stripes and a barrier rib material filling a space between the walls, the transfer material sheet being formed of a flexible material in a rolled form to couple the substrate on which the substrates have preliminarily been arranged and the support body so that the barrier rib material faces the substrate and to transfer the walls and the barrier rib material to the substrate in a single step, to thereby form the barrier ribs and the fluorescent layer on the substrate.

28. A method of manufacturing a panel comprising:

forming a plurality of walls made of a fluorescent material, the walls being arranged in stripes on a support body;

forming an electrode material layer on the walls;

filling a barrier rib material in a space between the walls;

coupling a substrate and the support body so that the barrier rib material faces the substrate; and transferring the walls, the electrode material layer and the barrier rib material to the substrate in one step, thereby to form barrier ribs, electrodes and a fluorescent layer.

29. A method according to claim 28, wherein the walls are belt-shaped in plan view.

* * * * *